United States Patent [19]

Sekine et al.

[11] Patent Number: 4,913,060

[45] Date of Patent: Apr. 3, 1990

[54] RUNNING GEAR FOR ELECTRIC ROLLING STOCK

[75] Inventors: Yasuhiro Sekine; Haruhisa Fujita; Sadafumi Ikeda, all of Amagasaki, Japan

[73] Assignee: Mitsubishi Denki Kabushiki Kaisha, Japan

[21] Appl. No.: 182,205

[22] Filed: Apr. 15, 1988

[30] Foreign Application Priority Data

May 14, 1987 [JP] Japan ..... 62-115772

[51] Int. Cl.[4] ..... B61C 9/50

[52] U.S. Cl. ..... 105/96; 105/60; 174/138 D; 464/900

[58] Field of Search ..... 464/177, 900; 403/202, 403/203, 306, 312, 337, 365, 372; 285/47, 48; 105/96, 108, 131, 35, 60, 76, 78, 34.1, 34.2; 174/138 D; 191/45, 49

[56] References Cited

U.S. PATENT DOCUMENTS 491,857 2/1893 Rae ..... 105/60
939,829 11/1909 Grundy ..... 464/900 X
3,195,374 7/1965 Coffin ..... 174/138 D
4,406,467 9/1983 Burger et al. ..... 285/47 X
4,407,602 10/1983 Terry, Jr. ..... 403/365 X

FOREIGN PATENT DOCUMENTS 1138562 12/1955 France ..... 174/138 D

OTHER PUBLICATIONS

"Mitsubishi WN Drive" Catalog No. C-C7331-A, FIG. 2.

*Primary Examiner*—Margaret A. Focarino
*Assistant Examiner*—Dean J. Kramer
*Attorney, Agent, or Firm*—Leydig, Voit & Mayer

[57] ABSTRACT

A running gear for an electric rolling stock has coupling devices for coupling the output shafts of traction motors to the input shafts of reduction devices which are provided with electrically resistive elements so as to prevent return current from flowing therethrough. Therefore, the coupling devices possess a higher level of resistance than the grounding resistance of the grounding devices, thereby enabling any return current to be prevented from flowing through the coupling devices. Thus, the running device can be kept free from electrolytic corrosion.

5 Claims, 3 Drawing Sheets

RUNNING GEAR FOR ELECTRIC ROLLING STOCK

BACKGROUND OF THE INVENTION

1. Field of the Invention

The present invention relates to a running gear for an electric rolling stock which is capable of preventing electrolytic corrosion.

2. Description of the Related Art

FIG. 1 illustrates a conventional running gear of this type which is shown in, for instance, *MITSUBISHI WN Drive* (Catalog No. A-C7331-A, issued by Mitsubishi Electric Corporation in November 1983). As shown in FIG. 1, paired wheels 2 are secured to both ends of axles 3 and are disposed in contact with tracks 1. The axles, consisting of a pair of axles 3, support a bogie transom 4 via associated axles boxes (none of which are shown). A pair of traction motors 5 are mounted at predetermined locations on the bogie transom 4, and their output shafts are disposed substantially in parallel with the axles 3. A reduction device 6 is mounted on each of the axles 3 with an end portion thereof supported by the bogie transom 4. Each of the traction motors 5 and each of the reduction devices 6 are coupled by means of a gear coupling 10. A grounding device 8 is provided on each reduction device 6 in such a manner as to be capable of coming into contact with the corresponding axle 3. Each of the grounding devices 8 is connected to the bogie transom 4 via a connecting wire 9.

With such a conventional running gear, when the traction motors 5 are started, the rotation of each traction motor 5 is transmitted to the corresponding reduction device 6 via the gear coupling 10, the speed of rotation is reduced to a predetermined speed by the reduction device 6, the axle 3 and the paired wheels 2 are rotated at the speed, and the electric rolling stock runs on the tracks 1 as the wheels 2 run thereon.

At this time, if, for instance, another vehicle runs near the rolling stock, return current may flow from the tracks 1 to some of the members of the rolling stock such as the bogie transom 4. In such a case, the return current flows through, for instance, the following path: one track 1→wheels 2→axles 3→grounding devices 8→connecting wires 9→bogie transom 4→connecting wires 9→grounding devices 8→axles 3→wheels 2→the one or the other track 1.

The above-described arrangement of the conventional running gear, however, encounters a problem in that, when the contact resistance of the grounding devices increases due to such factors as dust and moisture introduced into the grounding devices, the return current may flow from the tracks 1 to the bogie transom 4 through the reduction devices 6, the gear coupling 10, and the traction motors 5. This flow of the return current may adversely affect some of the component parts, such as bearings and gear surfaces, of these members by causing electrolytic corrosion thereof.

SUMMARY OF THE INVENTION

The present invention has been accomplished to overcome the above-described problem, and an object of the present invention is to provide a running gear for an electric rolling stock which is capable of preventing electrolytic corrosion of such members as the reduction devices and gear coupling.

According to the present invention, there is provided a running gear for an electric rolling stock comprising: at least one pair of axles having wheels capable of running on tracks; a bogie transom supported above the tracks by the axles; traction motors supported by the bogie transom; reduction devices for reducing the rotational speed of output shafts of the traction motors and for transmitting a reduced rotational speed to the axles; and coupling devices for transmitting the rotation of the output shafts of the traction motors to the input shafts of the reduction devices, wherein when the traction motors are driven, return current flows from the tracks to the axles and the bogie transom, the coupling devices each having electrically resisting elements for preventing any return current from flowing through the coupling devices.

Thus according to the present invention, the coupling devices which couple the output shafts of the traction motors to the input shafts of the reduction devices are provided with electrically resistive elements so as to prevent return current from flowing therethrough. By virtue of the provision of these electrically resistive elements, the coupling devices possess a level of resistance which is higher than the grounding resistance of the grounding devices, thereby enabling return current to be prevented from flowing through the coupling devices. Therefore, the running apparatus can be kept free from electrolytic corrosion.

DESCRIPTION OF THE PREFERRED EMBODIMENTS

The present invention will be described hereunder with reference to the accompanying drawings.

Figure 1:
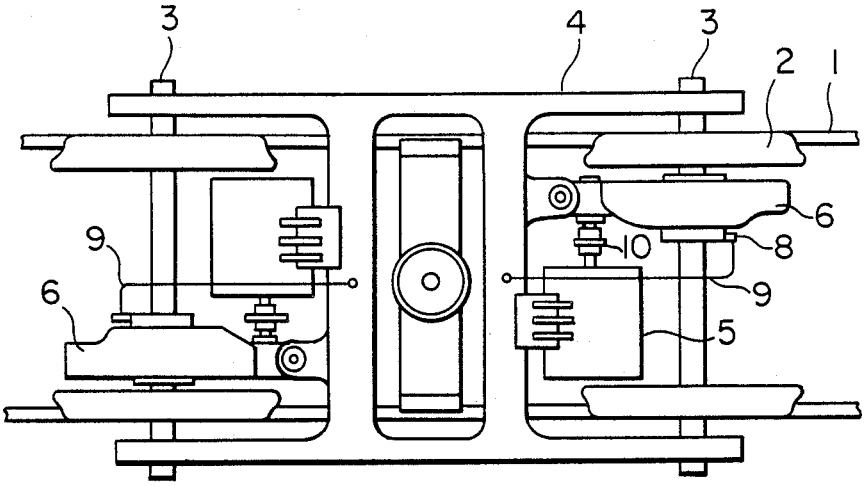
FIG. 1 PRIOR ART
FIG. 1 is a plan view illustrating a conventional, running gear for an electric rolling stock.
Figure 2:
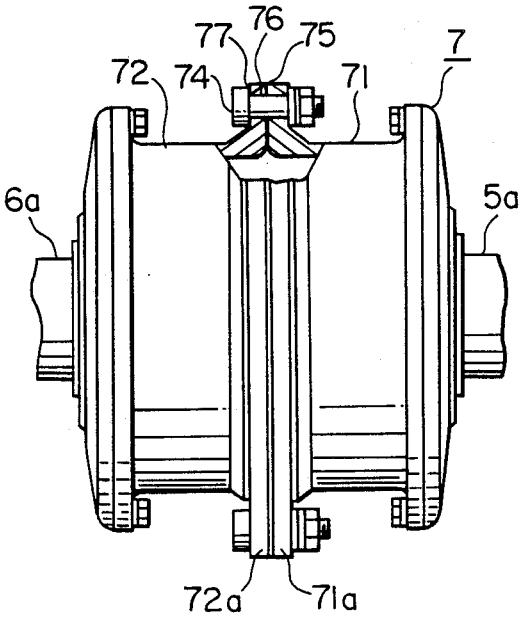
FIG. 2 is a partially sectioned front view showing a gear coupling of a running gear for an electric rolling stock in accordance with a first embodiment of the present invention.
Figure 3:
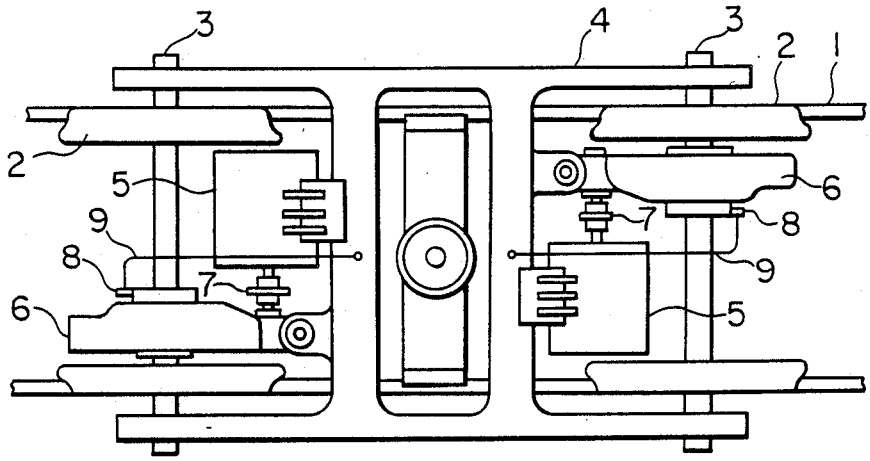
FIG. 3 is a plan view showing the running gear having the gear coupling shown in FIG. 2.

FIGS. 2 and 3 illustrate a first embodiment of the present invention. FIG. 2 is a partially sectional front view of a gear coupling of a running gear for an electric rolling stock in accordance with the first embodiment, and FIG. 3 is a plan view of the running apparatus having the gear coupling shown in FIG. 2. In these drawings, reference numerals 1 to 6, 8, and 9 denote the same components as those shown in FIG. 1, The traction motors 5 and the reduction devices 6 are coupled by means of coupling devices 7, which consist of, for instance, gear couplings. As shown in FIG. 2, each of the coupling devices 7 basically comprises first and second containers 71 and 72 receiving on the inner peripheries thereof internal gears (not shown). The containers 71 and 72 have a first and a second flanges 71*a* and 72*a*, respectively, which are disposed in opposition. A first resisting element 75 having a predetermined insulating resistance are provided between the opposing flanges 71*a* and 72*a* of the containers 71 and 72 of each coupling device 7. Each coupling device 7 has joining devices 74 (only one of which is shown in detail in FIG.

2) which join the first and second containers 71 and 72 together. Each of the joining devices 74 includes a bolt and a nut and penetrates through a hole formed in the flanges 71*a* and 72*a*. Second resisting elements 76 are each provided on the portion of each device 74 that penetrates through the flanges 71*a* and 72*a*, and third resisting elements 77 are each provided on one of the containers 71 and 72 with which the joining devices 74 are associated, for instance, on the second container 72. In FIG. 2, reference numeral 5*a* denotes an output shaft of the corresponding traction motor 5, and reference numeral 6*a* denotes an input shaft of the corresponding reduction device 6. Each of these shafts 5*a* and 6*a* has an external gear (not shown) secured thereto for meshing engagement with the internal gear (not shown) in the containers 71 and 72, so that the rotation of the motor 5 is transmitted to the reduction device 6.

The electric resistance across the grounding devices 8 is usually in the order of several tens of mΩ, and this resistance is at most on the order of several hundreds of mΩ when it is increased due to certain factors. Therefore, according to the present invention, the first to third electrically resistive elements 75, 76, and 77 are provided on the joint of portions of each coupling device 7 so as to provide an insulating electrically resistive on the order of 1Ω. Each of the resisting elements is formed of, for instance, a sheet of "Nomex" (a product of Du Pont), a heat resistant polymer composed of an aromatic polyamide, which has a thickness of 1 mil.

The present inventors have confirmed that, with the running apparatus in which the electrically resistive elements 75, 76, and 77 are provided in each of the coupling devices 7, when the traction motors 5 are driven and the electric rolling stock is running on the tracks 1, and simultaneously when return current is generated, the return current is allowed to flow from and to the tracks 1 passing through the grounding devices 8 because the coupling devices 7 have a higher level of resistance than the grounding devices 8.

Figure 4:
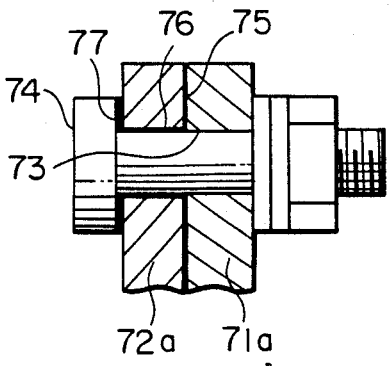
FIGS. 4, 5, 6, 7, and 8 are fragmentary sectional views showing joining devices of running gears in accordance with second, third, fourth, fifth, and sixth embodiments of the present invention, respectively.

In the above-described first embodiment, the electrically resistive elements 76 are each provided between the entire surface of the hole formed through the flanges 71*a* and 72*a* and the mating surface of the corresponding joining device 74 that penetrates therethrough. However, a similar effect can be achieved if, as shown in FIG. 4 illustrating a second embodiment, electrically resistive elements 76 (only one of which is shown) are each provided on only that part of the through hole 73 corresponding to one of the flanges, for instance, corresponding to the flange 72*a* of the second container 72. This arrangement also prevents return current from flowing through the coupling devices 7. It is preferred that the resisting elements possess a higher level of resistance than the grounding devices, and they may consist of insulators.

Figure 5:
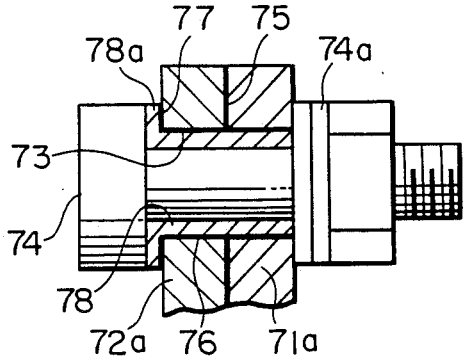

FIG. 5 illustrates a joining device 74 of a running gear in accordance with a third embodiment. In this embodiment, a metal bush 78 is inserted between each of the joining devices 74 and the corresponding through hole 73 formed in the flanges 71*a* and 72*a*. Electrically resistive elements 76 are each inserted between each bush 78 and each through hole 73, while electrically resistive elements 77 are each inserted between a flange 78*a* of each bush 78 and the opposing surface of the flange of one of the containers 71 and 72, e.g., of the flange 72*a*. With this arrangement, when it is necessary to disassemble the joining devices 74, the bushes 78 need not be disassembled, and it is therefore possible to prevent the electrically resistive elements 76 and 77 from becoming damaged during disassembly.

In FIG. 5, reference numeral 74*a* denotes a washer. If, as shown in FIG. 6 illustrating a fourth embodiment, each of the bushes 78 is inserted in such a manner as to be directed in the opposite direction, the flange 78*a* of each bush 78 can be used as a washer.

Figure 6:
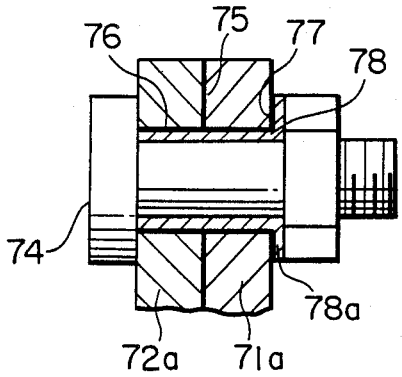

Although in the third and fourth embodiments illustrated in FIGS. 5 and 6, respectively, the bushes 78 are made of metals, the bushes 78 may alternatively be made of an insulating material. In this case, since the bushes themselves serve as the electrically resistive elements, e resisting elements 76 and 77 can be omitted.

Figure 7:
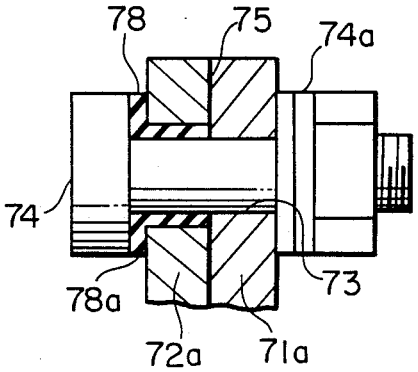

FIG. 7 illustrates a joining device 74 of a running gear in accordance with a fifth embodiment. In this embodiment, the bushes 78 are made of an insulating material. Each of the bushes 78 has at one end portion thereof a flange 78*a* registering with the flange of one of the containers 71 and 72, e.g., with the flange 72*a* of the second container 72, and each bush 78 has its the other end portion inserted through that portion of the through hole 73 corresponding to the flange portion 72*a*. In this embodiment, since the bushes 78 made of insulating materials, they serve as resisting elements in such a manner as to cooperate with the resisting elements 75 to substantially prevent return current from flowing through the containers 71 and 72.

Figure 8:
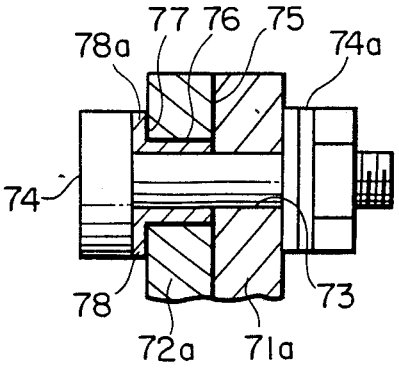

FIG. 8 illustrates a joining device 74 of a running gear in accordance with a sixth embodiment. In this embodiment, bushes 78, which are made of metals, are disposed in the same manner as that in the embodiment shown in FIG. 7, while electrically resistive elements 76 and 77 are provided between registration surfaces of the bushes 78 and the flange 72*a* of the second container 72. With this arrangement, an effect similar to that of the embodiment shown in FIG. 7 can be obtained.

Each of the embodiments illustrated in FIGS. 7 and 8 may be modified in the same manner as the embodiments illustrated in FIGS. 5 and 6 by directing the joining device 74 in the opposite direction. With this arrangement, the flanges 78*a* of the bushes 78 can serve as washers, thereby enabling omission of the washers 74*a*.

Materials which can be used for forming the bushes 78 are not particularly limited to the above-mentioned metals and insulating materials, and any other suitable materials may alternatively be used.

The foregoing first to sixth embodiments merely illustrate the present invention to facilitate understanding thereof. It is to be understood that various modifications and changes can be made.

Although in the first and second embodiments "Nomex" sheets are used as the electrically resistive elements, the present invention is not limited thereto. Similar effects could be provided by using other materials commonly used, such as an insulating coating, or an insulating sealing material, or by forming the elements by flame-spraying ceramic materials.

What is claimed is:

1. A running gear for an electric rolling stock comprising:

at least one pair of axles having wheels capable of running on tracks;

a bogie transom supported above the tracks by said axles;

traction motors supported by said bogie transom;

reduction devices which reduce the rotational speed of output shafts of said traction motors and which transmit a reduced rotational speed to said axles; and gear couplings which transmit the rotation of the output shafts of said traction motors to input shafts of said reduction devices, said gear couplings comprising a first container which has a first flange, a second container which has a second flange disposed in opposition to said first flange of said first container and which surrounds a gear portion in cooperation with said first flange, through holes formed through said first and second flanges, hollow bushes which have at one end portions thereof flanges registering with one of said first and second flanges and which have the other end portions thereof extended through portions of said through holes which correspond to at least one of said first and second flanges, and joining devices penetrating said through holes through said bushes and interposing between said first and second flanges so as to join said first and second containers, wherein when said traction motors are driven, return current flows from the tracks to said axles and said bogie transom, said gear couplings each having electrically resistive elements which prevent any return current from flowing through said coupling devices.

2. A running gear for an electric rolling stock according to claim 1, wherein said bushes are made of resisting or insulating material.

3. A running gear for an electric rolling stock according to claim 1, wherein bushes are made of a metal, said electrically resistive elements being disposed between said bushes and said through holes, between flanges of said bushes and portions of said first or second flanges which register with said bush flanges, and between the opposing portions of said first and second flanges.

4. A running gear for an electric rolling stock according to claim 1, wherein said electrically resistive elements are aromatic polyamide sheets.

5. A running gear for an electric rolling stock according to claim 1, wherein said electrically resistive elements are flame-sprayed ceramic bodies.

* * * * *